US010801519B2

(12) United States Patent
Kulathu et al.

(10) Patent No.: US 10,801,519 B2
(45) **Date of Patent: *Oct. 13, 2020**

(54) BLADE DISK ARRANGEMENT FOR BLADE FREQUENCY TUNING

(71) Applicant: Pratt & Whitney Canada Corp., Longueuil (CA)

(72) Inventors: Ram Kulathu, Mississauga (CA); Aldo Abate, Longueuil (CA)

(73) Assignee: PRATT & WHITNEY CANADA CORP., Longueuil, QC (CA)

( * ) Notice: Subject to any disclaimer, the term of this patent is extended or adjusted under 35 U.S.C. 154(b) by 513 days.

This patent is subject to a terminal disclaimer.

(21) Appl. No.: 15/202,934

(22) Filed: Jul. 6, 2016

(65) Prior Publication Data

US 2017/0097016 A1 Apr. 6, 2017

Related U.S. Application Data

(63) Continuation of application No. 13/313,485, filed on Dec. 7, 2011, now Pat. No. 9,410,436.

(60) Provisional application No. 61/420,927, filed on Dec. 8, 2010.

(51) Int. Cl.

| | |
|---|---|
| ***F04D 29/66*** | (2006.01) |
| ***F04D 29/38*** | (2006.01) |
| ***F04D 29/32*** | (2006.01) |
| ***F01D 5/26*** | (2006.01) |
| ***F01D 5/10*** | (2006.01) |

(52) U.S. Cl.

CPC ..... *F04D 29/668* (2013.01); *F01D 5/10* (2013.01); *F01D 5/26* (2013.01); *F04D 29/324* (2013.01); *F04D 29/329* (2013.01); *F04D 29/388* (2013.01); *F05D 2230/10* (2013.01); *F05D 2230/30* (2013.01); *F05D 2260/961* (2013.01)

(58) Field of Classification Search

CPC . F01D 5/10; F01D 5/26; F04D 29/324; F04D 29/329; F04D 29/388; F04D 29/668; F05D 2230/10; F05D 2230/30; F05D 2260/961

USPC .... 416/1, 61, 62, 144, 145, 190–193 A, 500

See application file for complete search history.

(56) References Cited

U.S. PATENT DOCUMENTS

| | | | | |
|---|---|---|---|---|
| 4,097,192 A * | 6/1978 | Kulina | ..... | F01D 5/14 416/175 |
| 4,361,213 A | 11/1982 | Landis, Jr. et al. | | |
| 4,879,792 A | 11/1989 | O'Connor | | |

(Continued)

FOREIGN PATENT DOCUMENTS

| | | |
|---|---|---|
| CA | 2596805 | 8/2006 |
| EP | 1188900 | 3/2002 |

OTHER PUBLICATIONS

Office Action received in counterpart Canadian application No. 2,761,208 dated Sep. 29, 2017.

*Primary Examiner* — David E Sosnowski
*Assistant Examiner* — Alexander A White
(74) *Attorney, Agent, or Firm* — Norton Rose Fulbright Canada LLP

(57) ABSTRACT

A gas turbine engine and a method of tuning a rotor in the gas turbine engine wherein the rotor includes an array of blades extending from a rotor hub each having an airfoil mounted to a blade platform. The method includes adding or removing material from bladed rotor projections to alter the mass of the rotor and change the frequency of the respective airfoil.

7 Claims, 2 Drawing Sheets

(56) References Cited

U.S. PATENT DOCUMENTS

| | | | | |
|---|---|---|---|---|
| 5,160,242 | A | 11/1992 | Brown | |
| 5,286,168 | A | 2/1994 | Smith | |
| 5,373,922 | A | 12/1994 | Marra | |
| 5,582,077 | A | 12/1996 | Agram et al. | |
| 6,354,780 | B1 * | 3/2002 | Davis | F01D 5/027 414/146 |
| 6,405,434 | B2 | 6/2002 | Landolt et al. | |
| 6,854,959 | B2 | 2/2005 | Barb | |
| 7,024,744 | B2 | 4/2006 | Martin et al. | |
| 7,069,654 | B2 | 7/2006 | Robbins | |
| 7,252,481 | B2 * | 8/2007 | Stone | F01D 5/02 416/239 |
| 7,347,672 | B2 | 3/2008 | Bertrand et al. | |
| 2010/0074752 | A1 * | 3/2010 | Denis | F01D 5/027 416/144 |

* cited by examiner

BLADE DISK ARRANGEMENT FOR BLADE FREQUENCY TUNING

CROSS-REFERENCE TO RELATED APPLICATIONS

This application is a continuation of U.S. patent application Ser. No. 13/313,485, filed Dec. 7, 2011 which claims priority on U.S. Provisional Application No. 61/420,927 filed on Dec. 8, 2010, the content of both applications being hereby incorporated by reference.

TECHNICAL FIELD

The present application relates to gas turbine engines and more particularly to improvements in a method and an arrangement for tuning/detuning a rotor blade array.

BACKGROUND ART

Gas turbine rotor assemblies rotate at extreme speeds. Inadvertent excitation of resonant frequencies by the spinning rotor can cause an unwanted dynamic response in the engine, and hence it is desirable to be able to tune, or mistune, the rotor in order to avoid specific frequencies or to lessen their effect.

SUMMARY

In accordance with a general aspect, there is provided a method of tuning a bladed rotor in a gas turbine engine, wherein the bladed rotor includes a circumferential array of blades extending from a rotor hub, each blade having an airfoil extending from a blade platform; the method comprising: providing a platform projection depending from every second blade, the platform projections together forming a circumferentially interrupted rib on the hub, and tuning the bladed rotor by adding or removing mass from at least one platform projection to alter the natural frequency of the rotor.

In accordance with another aspect, there is provided a bladed rotor for a gas turbine engine, the bladed rotor comprising a hub and a circumferential array of blades extending from the hub; each blade having an airfoil extending from a gaspath side of a platform provided at a periphery of the hub; and an annular array of projections depending from an interior side of the blade platform at circumferential locations generally corresponding to every second blade, the projections cooperating to form a circumferentially interrupted rib, the interrupted rib configured to provide a desired frequency response to the bladed rotor.

In accordance with a further general aspect, there is provided a method of tuning a bladed rotor for a gas turbine engine, the bladed rotor including a rotor hub having a circumferential array of airfoil blades extending therefrom, the hub having a gas path side defining a portion of the gas path in which the bladed assembly is to be mounted and an interior side opposite the gas path side; the method comprising: providing at least one projection extending from the rotor hub interior side, determining a frequency response of the bladed assembly in an as-manufactured condition, determining a desired frequency response, and then modifying the at least one projection to provide the bladed assembly with the desired frequency response.

BRIEF DESCRIPTION OF THE DRAWINGS

Reference is now made to the accompanying figures in which:

FIG. 3 is an isometric view of a portion of a bladed rotor illustrating an alternate rib-no-rib configuration for mistuning blade frequencies.

DESCRIPTION OF THE PREFERRED EMBODIMENTS

Figure 1:
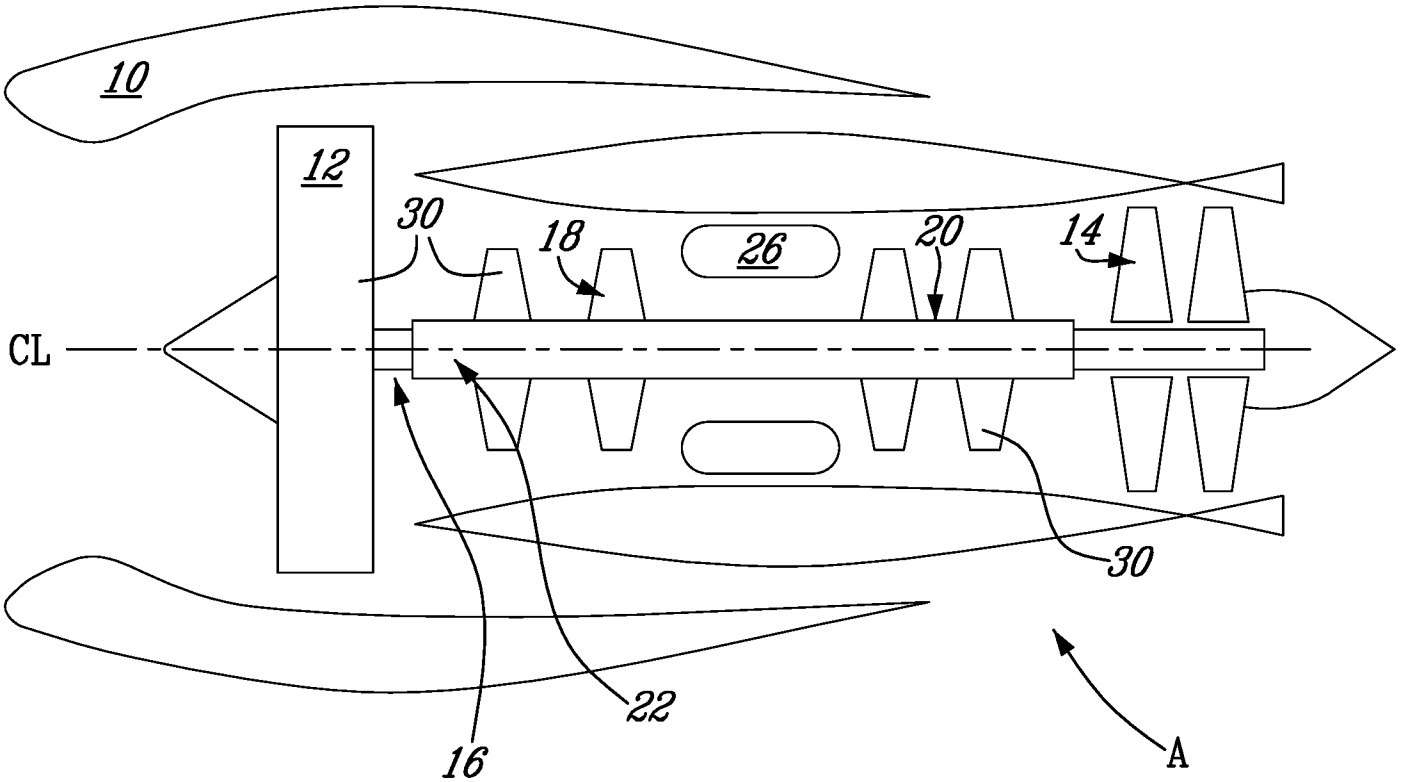
FIG. 1 is a schematic cross-sectional view of a gas turbine engine illustrating a turbofan configuration.
Figure 1:
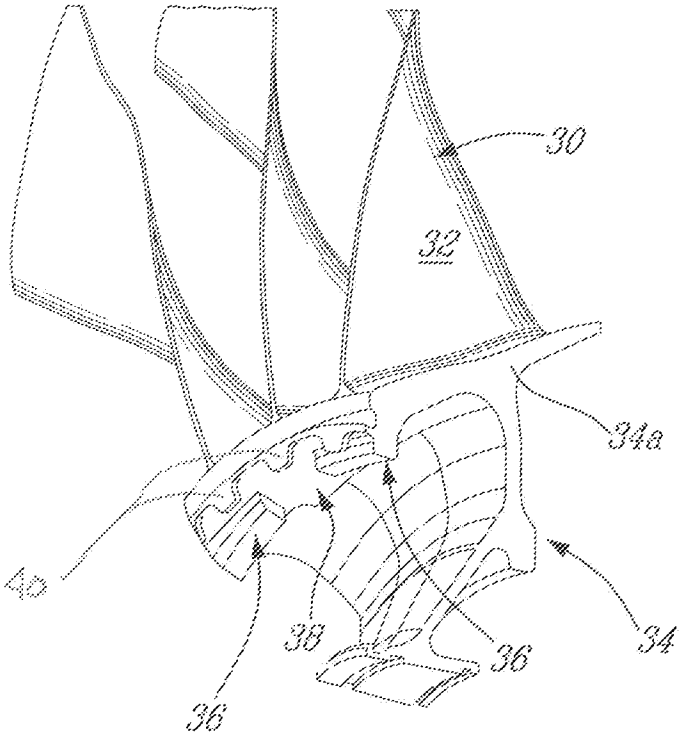

FIG. 1 schematically depicts a turbofan engine A which, as an example, illustrates the application of the described subject matter. The turbofan engine A includes a nacelle 10, a low pressure spool assembly which includes at least a fan 12 and a low pressure turbine 14 connected by a low pressure shaft 16, and a high pressure spool which includes a high pressure compressor 18 and a high pressure turbine 20 connected by a high pressure shaft 22. The engine A further comprises a combustor 26.

The fan 12, the high pressure compressor 18, the high pressure turbine 20 and the low pressure turbine 14, for the purposes of the present description include rotors represented by the blades 30 in FIG. 1.

Figure 2:
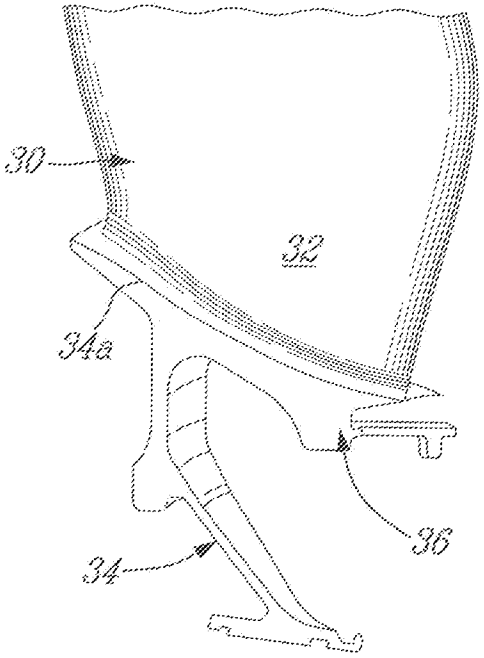
FIG. 2 is an isometric view partly fragmented showing a rib feature of a rotor blade that may be used for blade tuning.

The rotors, especially the fan 12, may be provided in the form of blisks, that is, in the form of integrally bladed disks (IBR). As shown in FIG. 2, the blades 30 are integrally formed with a rotor hub 34 in a unitary construction. Each blade 30 comprises an airfoil 32 extending from a gas path side of an annular platform 34*a* formed at the periphery of the rotor hub 34. As shown in FIG. 3, a first annular array of projections 40 depends from the platform 34*a*. As well known in the art and as for instance disclosed in US Patent Publication No. 2010/0074752, material can be added or removed from these features for weight balancing purposes. In use, the airfoils 32 may vibrate at different frequencies and in order to tune the rotor, the individual airfoils 32 must be tuned or mistuned. For instance, where adjacent airfoils have the same natural frequencies, the airfoils can excite each other. Thus, the airfoils may be mistuned to avoid the excitation.

As shown in FIGS. 2 and 3, a second series of projections 36 may be provided below the platform 34*a* or on the interior side of the platform 34*a* opposite to the gas path side thereof. As shown in FIG. 3, the projections 36 are located downstream of the projections 40 with respect to the direction of flow of the gas through the gas path. The projections 36 may be integrally formed with the platform 34*a*. The projections 36*a* may be provided in the form of rib features depending radially inwardly from the platform 34*a*. The projections 36 may be identical in term of shapes and sizes. The projections 36 may also be circumferentially spaced-apart in annular alignment forming a regular rib but which is interrupted by voids or spaces 38. In the embodiment shown in FIG. 3, a projection 36 is provided at alternate or on every second blade 30 and, therefore, at every second airfoil for the purpose of tuning or mistuning the airfoil. However, it is understood that various number of projections may be provided. As shown in FIGS. 2 and 3, the projections 36 may be provided at the leading edge of the platform 34*a* forwardly of the center of gravity of the blades 30, but other suitable locations for the projection may be used (e.g. platform trailing edge).

If the airfoils 32 of two adjacent blades 30 have the same natural frequency, one may mistune the blade 30 to which a projection 36 is dependent so that the frequency of the respective airfoil 32 will be mismatched to the frequency of the airfoil 32 on the adjacent blade 30.

The projections 36 may be tuned or mistuned by removing material therefrom thereby altering the mass thereof, causing the respective airfoil 32 to be modified in terms of its frequency. Alternately, material can be added to the projection 36 by a bonding process like welding. A projection 36 or similar rib features depending from the blade platform may be in this manner used to control blade frequencies.

The array of projections 36 are shown as being located at the leading edge of the platform 34*a* but it is understood that the array of projections 36 may be located at the trailing edge or other suitable location on the platform 34*a*. The shape of the projections 36 making up the array may be identical forming a regular shaped rib albeit interrupted.

It can be appreciated that a gas turbine engine rotor may be tuned by providing at least one projection extending from a platform interior side, determining a frequency response of the bladed rotor in an as-manufactured condition, determining a desired frequency response, and then modifying the at least one projection to provide the bladed rotor with the desired frequency response. Modifying the at least one projection may be done by removing material from the projection or by adding material thereto.

The material addition (i.e. the projections 36) on the disk provides a convenient way of changing the blade frequencies. The projections 36 may be used to tune or mistune the blades (where frequencies of adjacent blades are different) to provide the bladed rotor with the desired frequency response.

The above description is meant to be exemplary only, and one skilled in the art will recognize that changes may be made to the embodiments described without departing from the scope of the invention disclosed. For instance, it will be understood that he present teaching may be applied to any bladed rotor assembly, including but not limited to fan and compressor rotors, and may likewise be applied to any suitable rotor configuration, such as integrally bladed rotors, conventional bladed rotors etc. Any modifications which fall within the scope of the present invention will be apparent to those skilled in the art, in light of a review of this disclosure, and such modifications are intended to fall within the scope of the appended claims.

What is claimed is:

1. A bladed rotor for a gas turbine engine, comprising: a hub and a circumferential array of blades extending from the hub, each blade having an airfoil extending from a gaspath side of a blade platform provided at a periphery of the hub; a first annular array of projections depending from an interior side of the blade platform, and a second annular array of projections depending from the interior side of the blade platform at circumferential locations corresponding to every second blade, the projections of the second annular array of projections cooperating to form a circumferentially interrupted rib, a weight of each projection of the second annular array of projections being adjustable to modify a natural frequency of a corresponding blade, wherein the second annular array of projections is disposed axially aft of the first annular array of projections on a same forward or rearward side of the platform relative to a center of gravity of the blades.

2. The bladed rotor defined in claim 1, wherein the projections of both the first and second annular arrays of projections extend radially inwardly from the interior side of the platform.

3. The bladed rotor defined in claim 2, wherein the projections of both the first and second annular arrays of projections are located at a leading edge of the platform.

4. The bladed rotor defined in claim 2, wherein the projections of both the first and second annular arrays of projections are located at a trailing edge of the platform.

5. The bladed rotor defined in claim 1, wherein the projections of the second annular array of projections are substantially identical in terms of shape and mass.

6. The bladed rotor defined in claim 1, wherein the bladed rotor is an integrally bladed rotor, the projections of the second annular array of projections being integral to the platform.

7. A method of tuning a bladed rotor for a gas turbine engine, the bladed rotor including a rotor hub having a circumferential array of airfoil blades extending from a platform, the platform having a gas path side defining a portion of a gas path in which the bladed rotor is to be mounted and an interior side opposite the gas path side, and a first annular array of projections depending from the interior side; the method comprising: providing at least one further projection extending from the interior side of the platform, the at least one further projection being disposed axially aft of the first annular array of projections on a same forward or rearward side of the platform relative to a center of gravity of the blades; determining a frequency response of the bladed rotor in an as-manufactured condition; determining a desired frequency response; and then modifying the at least one projection to provide the bladed rotor with the desired frequency response.

* * * * *